US006223013B1

(12) United States Patent
Eklund et al.

(10) Patent No.: US 6,223,013 B1
(45) Date of Patent: Apr. 24, 2001

(54) WIRE-LESS HYBRID SCAVENGELESS DEVELOPMENT SYSTEM

(75) Inventors: Elliott A. Eklund, Penfield; Yelena Shapiro, Rochester; Dan A. Hays; John F. Knapp, both of Fairport, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/211,264

(22) Filed: Dec. 14, 1998

(51) Int. Cl.[7] ..... G03G 15/08
(52) U.S. Cl. ..... 399/266; 399/290
(58) Field of Search ..... 399/266, 290, 399/291, 265, 272, 281, 282; 430/102, 120

(56) References Cited

U.S. PATENT DOCUMENTS 3,697,169 * 10/1972 Maksymiak et al. ..... 430/102 X
3,707,390 * 12/1972 Sullivan, Jr. ..... 399/290 X
3,914,460 * 10/1975 Maksymiak ..... 430/120
3,998,185 * 12/1976 Weiler ..... 399/265
3,999,849 * 12/1976 Maksymiak et al. ..... 399/143
4,119,060 * 10/1978 Mochizuki et al. ..... 399/284
5,613,178 * 3/1997 Amico ..... 399/266
5,809,385 * 9/1998 Snelling et al. ..... 399/266
5,899,608 * 5/1999 Eklund et al. ..... 399/266

FOREIGN PATENT DOCUMENTS 58-021277 * 2/1983 (JP) .
5-204237 * 8/1993 (JP) .

* cited by examiner

*Primary Examiner*—William Royer
*Assistant Examiner*—Sophia S. Chen
(74) *Attorney, Agent, or Firm*—Lloyd F. Becn, II

(57) ABSTRACT

An apparatus for developing a latent image recorded on an imaging surface, including a housing defining a reservoir storing a supply of developer material including toner. A donor member is spaced from the imaging surface, for transporting toner on an outer surface of the donor member to a region opposed from the imaging surface. A mag roll loads toner onto a region of the outer surface of the donor member. A charging device ion charges the toner loaded on the region of the donor member. An AC/DC voltage supply for biasing the donor member positioned in close proximity to the imaging member to detach toner from the donor member as to form a toner cloud for developing the latent image. A second charging device discharges and removes residual toner on the region of the donor and returning the toner to the reservoir.

7 Claims, 3 Drawing Sheets

WIRE-LESS HYBRID SCAVENGELESS DEVELOPMENT SYSTEM

BACKGROUND OF THE INVENTION

This invention relates generally to a development apparatus for ionographic or electrophotographic imaging and printing apparatuses and machines, and more particularly is directed to a two component development system wherein a donor roll is loaded with triboelectrically charged toner particles, and subsequently the toner is charged by a corona device.

Generally, the process of electrophotographic printing includes charging a photoconductive member to a substantially uniform potential so as to sensitize the surface thereof. The charged portion of the photoconductive surface is exposed to a light image from either a scanning laser beam, an LED array or an original document being reproduced. By selectively discharging certain areas on the photoconductor, an electrostatic latent image is recorded on the photoconductive surface. This latent image is subsequently developed by charged toner particles supplied by the development sub-system.

Powder development systems normally fall into two classes: two component, in which the developer material is comprised of magnetic carrier granules having toner particles adhering triboelectrically thereto and single component, which typically uses toner only. Toner particles are attracted to the latent image forming a toner powder image on the photoconductive surface. The toner powder image is subsequently transferred to a copy sheet, and finally, the toner powder image is heated to permanently fuse it to the copy sheet in image configuration.

The operating latitude of a powder xerographic development system is determined to a great degree by the ease with which toner particles are supplied to an electrostatic image. Placing charge on the particles, to enable movement and imagewise development via electric fields, is most often accomplished with triboelectricity. However, all development systems which use triboelectricity to charge toner, whether they be two component (toner and carrier) or mono-component (toner only), have one feature in common: charges are distributed non-uniformly on the surface of the toner. This results in high electrostatic adhesion due to locally high surface charge densities on the particles. Toner adhesion, especially in the development step, is a key factor which limits performance by hindering toner release. As the toner particle size is reduced to enable higher image quality, the charge Q on a triboelectrically charged particle, and thus the removal force (F=QE) acting on the particle due to the development electric field E, will drop roughly in proportion to the particle surface area. On the other hand, the electrostatic adhesion forces for tribo-charged toner, which are dominated by charged regions on the particle at or near its points of contact with a surface, do not decrease as rapidly with decreasing size. This so-called "charge patch" effect makes smaller, tribo-charged particles much more difficult to develop and control.

Jumping development systems, in which toner is required to jump a gap to develop the electrostatic latent image, are capable of image quality which can be superior to in-contact systems, such as magnetic brush development. Unfortunately, they are also much more sensitive to toner adhesion. In fact, high toner adhesion has been identified as a major limitation in jumping development. Up to now, mechanical and/or electrical agitation of toner have been used to break these adhesion forces and allow toner to be released into a cloud for jumping development. This approach has had limited success, however. More agitation often releases more toner, but high adhesion due to triboelectric charging still dominates in toner cloud generation and causes unstable development. For full color printing system architectures in which the complete image is formed on the image bearing member, an increase in toner delivery rate produces a highly interactive toner cloud, which disturbs previously developed particles on the latent image. This erases many of the original benefits of jumping development for color xerographic printing for the so-called image-on-image (IOI) architecture. Again, as the toner size is reduced, the above limitations become even more acute due to increased toner adhesion.

Given that charged particle adhesion is a major limiting factor in development with dry powder, it has been a goal to identify toner charging and delivery schemes which keep toner adhesion low. Clearly, the adhesion of the charged toner depends sensitively on the method used to charge the particles.

Another problem is that it is extremely difficult to attain stable charge levels of 40 $\mu$C/g that are required for uniform loading and reloading of the donor roll with conductive development materials. Stable charge levels of that magnitude can be attained with insulative carrier but these lead to severe reload defects. The developer cannot load sufficient toner onto the donor roll to compensate for the toner developed on the previous revolution. Conductive carrier designs have been identified that have sufficiently high initial charge levels, but these have all been very unstable with time.

For optimum development of edges in cloud based systems, a charge level of 40 $\mu$C/g or higher is desirable. However, it is extremely difficult to attain stable charge levels of that magnitude with conductive development materials, which are required for uniform loading and reloading of the donor roll.

As a result, non-interactive development for Image-on-Image (IOI) full color printing systems suffers from serious limitations on development latitude. The primary constraint is that development is strongly dependent on the adhesion of the toner. To make matters worse, toner adhesion often fluctuates significantly with the changing operating conditions of the hardware and the state of the developer materials, causing both long and short time stability problems.

In Hybrid Scavengeless Development (HSD) systems used for non-interactive development in IOI color printers, a series of AC biased wires are closely spaced from a donor roll to detach toner and form a cloud. The HSD system has limitations due to mechanical vibration of the wires (strobing) and wire contamination due to the trapping and attachment of debris (e.g. fibers or toner particles). Both problems result in image noise and visible print defects. Wire motion issues also limit the maximum process width, because longer wires exacerbate the strobing problem.

An object of the present invention is to remove problems associated with toner adhesion and wires employed in such scavengeless development.

SUMMARY OF THE INVENTION

There is provided an apparatus for developing a latent image recorded on an imaging surface, including a housing defining a reservoir storing a supply of developer material comprising toner. A donor member spaced from the imaging surface transports toner on an outer surface of the donor member to a region opposed from the imaging surface. A magnetic brush roll loads toner onto a region of the outer surface of the donor member. A charging device ion charges the toner loaded on donor member. An AC/DC voltage supply biases the donor member positioned in close proximity to the imaging member to detach toner from the donor member to form a toner cloud for developing the latent image. A second charging device discharges and removes residual toner from the donor for return of the toner to the reservoir.

DETAILED DESCRIPTION OF THE FIGURES

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 3 printing machine will be shown hereinafter schematically and their operation described briefly with reference thereto.

Figure 1:
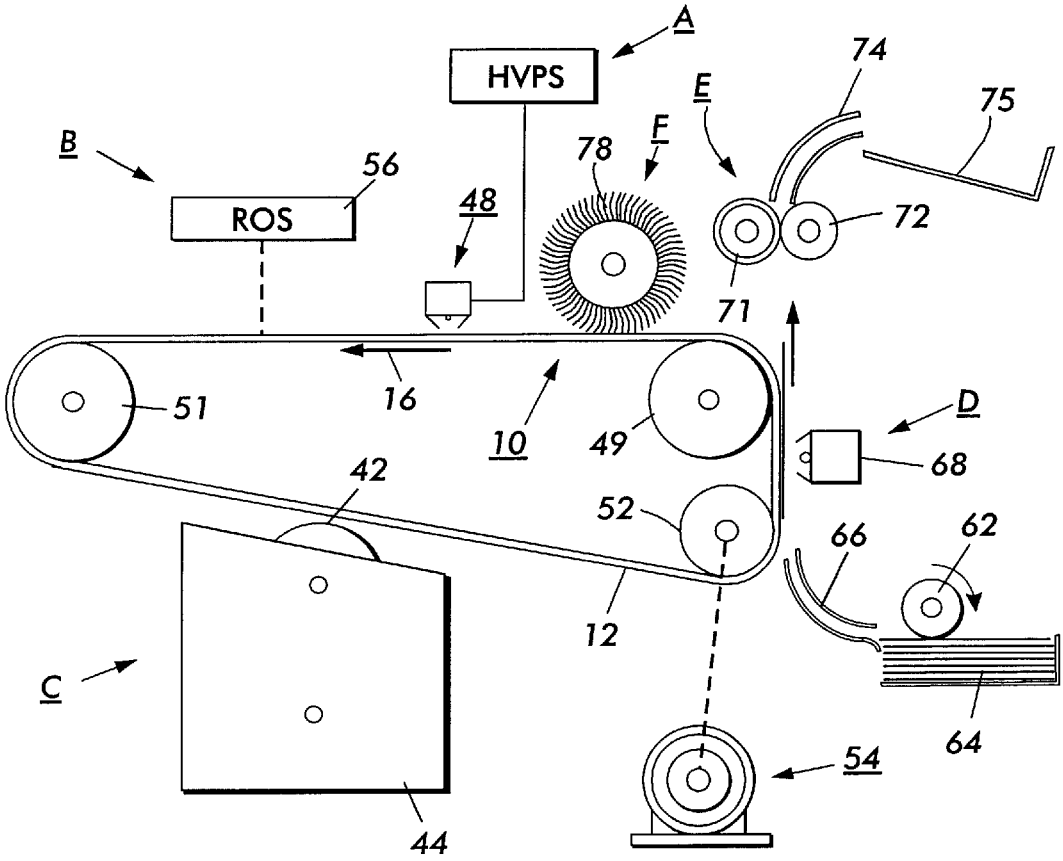
FIG. 1 is a schematic elevational view of an illustrative electrophotographic printing machine incorporating the present invention therein.

Referring initially to FIG. 1, there is shown an illustrative electrophotographic printing machine incorporating the development apparatus of the present invention therein. The printing machine incorporates a photoreceptor 10 in the form of a belt having a photoconductive surface layer 12. Preferably the surface 12 is made from a selenium alloy. The substrate is preferably made from an aluminum alloy or a suitable photosensitive organic compound. The substrate is preferably made from a polyester film such as MYLAR™ (a trademark of Dupont (UK) Ltd.) which has been coated with a thin layer of aluminum alloy which is electrically grounded. The belt is driven by means of motor 54 along a path defined by rollers 49, 51 and 52, the direction of movement being counter-clockwise as viewed and as shown by arrow 16. Initially a portion of the belt 10 passes through a charge station A at which a corona generator 48 charges surface 12 to a relatively high, substantially uniform, potential. A high voltage power supply is coupled to device 48.

Next, the charged portion of photoconductive surface 12 is advanced through exposure station B. At exposure station B, ROS 56 lays out the image in a series of horizontal scan lines with each line having a specified number of pixels per inch. The ROS includes a laser having a rotating polygon mirror block associated therewith. The ROS imagewise exposes the charged photoconductive surface 12.

Figure 3:
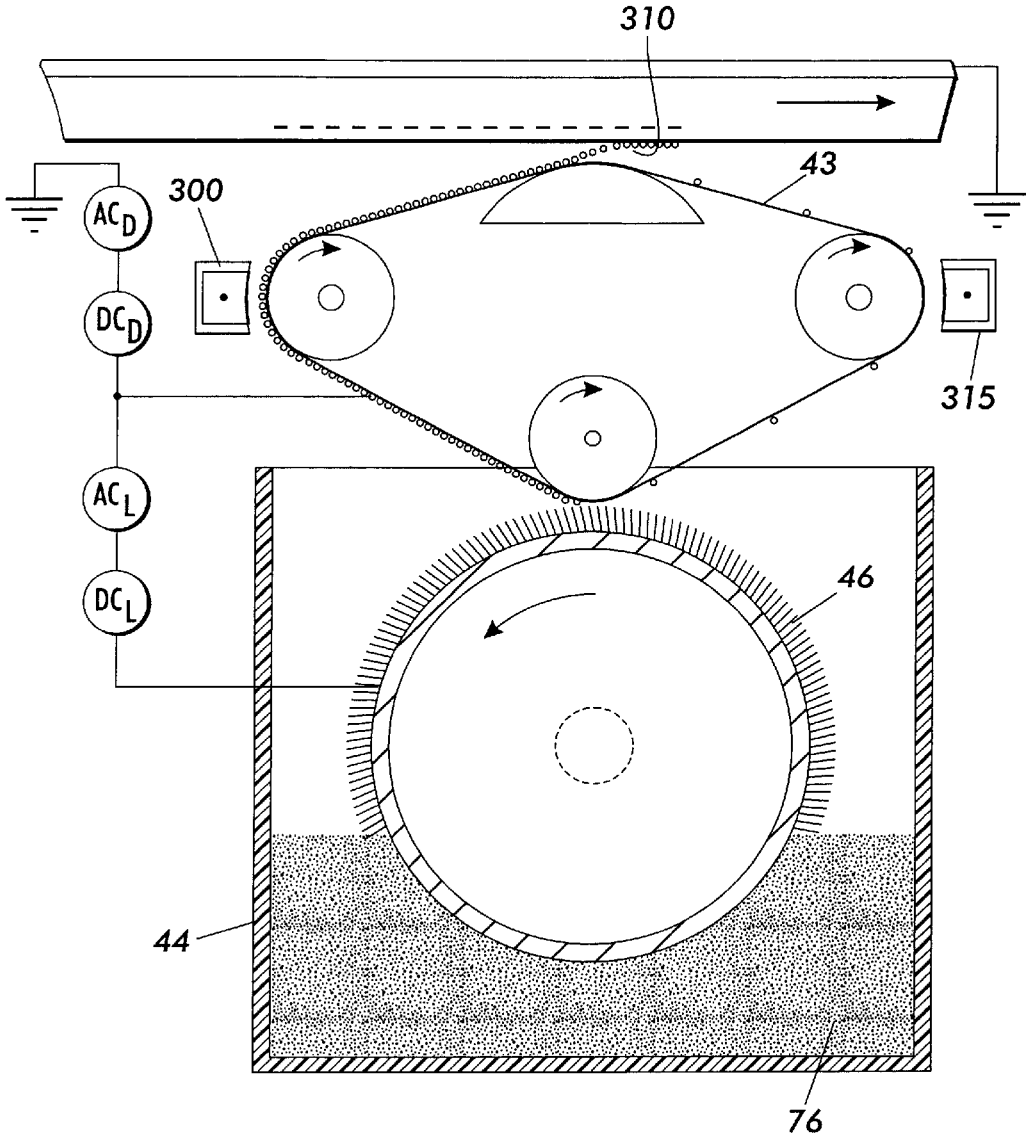
FIG. 3 is a second embodiment of the present invention which employs a flexible belt as the donor.

After the electrostatic latent image has been recorded on photoconductive surface 12, belt 10 advances the latent image to development station C as shown in FIG. 3. At development station C, a development system or developer unit 34, develops the latent image recorded on the photoconductive surface. The chamber in the developer housing stores a supply of developer material. The developer material may be a two component developer material consisting primarily of a mixture of toner particles and carrier beads. The developer material may be a custom color consisting of two or more different colored dry powder toners.

Again referring to FIG. 1, after the electrostatic latent image has been developed, belt 10 advances the developed image to transfer station D, at which a copy sheet 64 is advanced by roll 62 and guides 66 into contact with the developed image on belt 10. A corona generator 68 is used to charge the back of the sheet so as to attract the toner image from belt 10 to the sheet. As the belt turns around roller 49, the sheet is stripped therefrom with the toner image thereon.

After transfer, the sheet is advanced by a conveyor (not shown) to fusing station E. Fusing station E includes a heated fuser roller 71 and a back-up roller 72. The sheet passes between fuser roller 71 and back-up roller 72 with the toner powder image contacting fuser roller 71. In this way, the toner powder image is permanently affixed to the sheet. After fusing, the sheet advances through chute 74 to catch tray 75 for subsequent removal from the printing machine by the operator.

After the sheet is separated from photoconductive surface 12 of belt 10, the residual developer material adhering to photoconductive surface 12 is removed therefrom by a rotating fibrous brush 78 at cleaning station F in contact with photoconductive surface 12. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
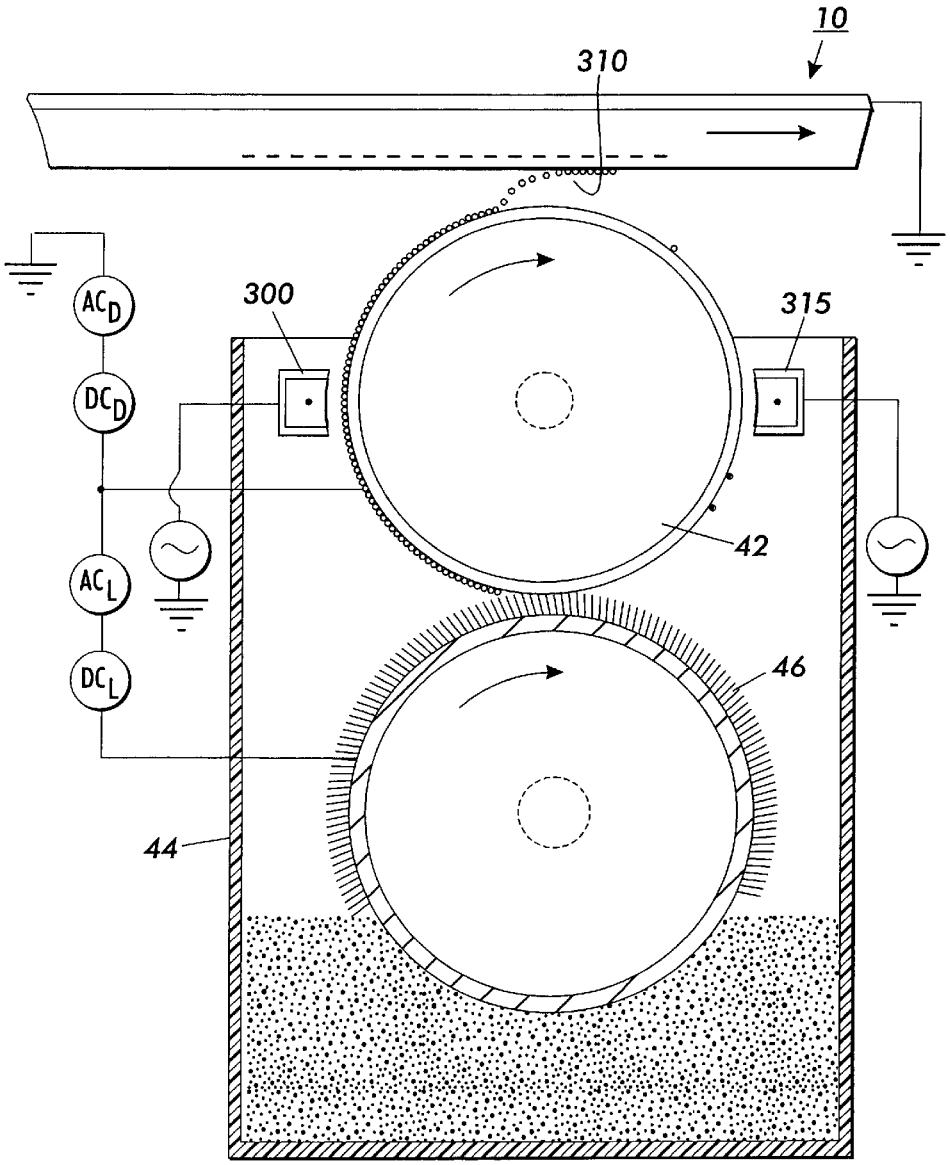
FIG. 2 is a schematic illustration of the development system according to the present invention.

Referring now to FIG. 2, as the donor 42 rotates in the direction of arrow, A DC or DC plus AC voltage is applied to the donor roll to electrostatically transfer the desired polarity of toner to the roll. Donor roll 42 is mounted, at least partially, in the chamber of developer housing 44. The chamber in developer housing 44 stores a supply of developer material. Developer material employed is two component conductive development materials. Donor 42 develops toner via conventional magnetic brush 46 onto the surface of donor 42. This donor roll generally consists of a conductive aluminum core covered with a thin (50 $\mu$m) insulating anodized layer. The magnetic brush roll is held at an electrical potential difference relative to the donor core to produce the field necessary for toner development on to donor 42.

As successive electrostatic latent images are developed, the toner particles within the chamber 76 are depleted to an undesirable level. A toner dispenser (not shown) stores a supply of toner particles. The toner dispenser is in communication with chamber 76 of housing 44. As the level of toner particles in the chamber is decreased, fresh toner particles are furnished from the toner dispenser.

In the developer housing 44 the developer acquires a triboelectric charge preferably less than about 5 $\mu$C/g. A layer of the triboelectric charged toner is loaded onto donor 42 by magnetic brush 46. The amount of toner deposited on the donor is controlled by the toner concentration in the developer and the bias between the donor and the magnetic brush. The typical toner layer thickness on the donor surface is between 1 and 3 monolayers. Next the layer of charged toner is brought under corona charging device 300, where the toner is charged to an average Q/M ratio of from 30 to 50 $\mu$C/g. Corona device 300 may be in the form of an AC or DC charging device (e.g. scorotron). As donor 42 is rotated further in the direction indicated by arrow 68, the now charged toner layer is moved into development zone 310, defined by the gap between donor 42 and the surface of the photoreceptor belt 10. This development gap is typically in the range of 0.125 to 0.75 mm. The toner layer on the donor roll is then disturbed by AC/DC electric fields applied to the donor so as to produce an agitated cloud of toner particles. Toner from the cloud is then developed onto the nearby photoreceptor by fields created by a latent image.

The present invention removes limitations on non-interactive development by using ion charging as the primary toner charging mechanism. Ion toner charging distributes charges uniformly on the surface of the toner particles, lowering toner adhesion by about an order of magnitude compared to triboelectric charging, and thus relaxing many development system constraints.

The invention is shown schematically in FIGS. 2 and 3. Two component development is used to load a uniform layer of toner onto a donor member, which can be a roll (FIG. 2) or a continuous belt 43 (FIG. 3). A DC potential, or a combination of DC and AC voltages ($DC_L$ and $AC_L$), can be used in this loading step. The triboelectric charging of toner in the two component donor loading step is kept to a minimum by adjustments to the carrier coating and external surface additives on the toner. At this stage, the toner charge is still high enough for magnetic brush loading of the donor, but is low enough so as to minimize adhesion to the donor. Ion charging is then used to raise the charge level of the toner to a value which enables jumping development. Preferably the charge level ranges from about 30 to 50 $\mu$C/g. Ion charging thus overwhelms the previous triboelectric charge signature on the toner particles, rendering them available for jumping development while keeping their adhesion low.

Because of this reduction in toner adhesion, latent image development is possible solely with DC fields in the development nip. This DC field is provided by both the DC bias of from 0 to 1000 volts from power supply, and the latent image 14 on photoconductor 10. The usual fringe electric fields, produced by AC biased wires near the donor surface in an HSD system, are no longer required. However, the addition of AC voltages in the range of 0 to 1000 volts peak-to-peak between the donor and photoreceptor is helpful in bringing the toner cloud closer to the latent image, improving the development of fine lines and edges. These are the voltages $DC_D$ and $AC_D$ in FIG. 2. With the highly adhering triboelectrically charged toner used currently with HSD systems with AC biased wires, high AC signals must be applied to manipulate the toner cloud. An advantage with the present invention employing ion charged toner is that these AC excitations can be lowered, still allowing the cloud to be manipulated but avoiding the undesirable scavenging behavior. To avoid problems caused by charge build-up in the developer sump, undeveloped toner on the donor is partially neutralized by another corona device 315 to bring its charge back to the level before ion charging. This residual toner is finally re-circulated through the two component loading nip, where any signature of image development on the donor is erased as a fresh layer of toner is deposited.

The advantages of the present invention are summarized as follows:

1). Reduced toner adhesion eliminates the need for AC biased wires to detach toner from the donor during development. This removes some significant sources of noise in HSD systems, such as wire contamination, strobing and variations in developed density caused by modulations of the wire to donor spacing.

2). A wire-free HSD design also opens possibilities for increasing the process width. The maximum width for the roll configuration (FIG. 2), would be limited only by roll run-out and straightness. There may even be an increased tolerance of variations in development gap produced by these roll defects when ion charged toner is used. Even wider development is possible with the belt and stationary backing shoe configuration of FIG. 3, where straightness of the backing shoe is the remaining limitation.

3). The significant decrease in particle adhesion made possible with ion charging reduces the sensitivity of development to toner adhesion, allowing increased latitude. Higher toner delivery rates and thus higher speeds are possible. In addition, gentle release of toner from the development system creates a non-interactive toner cloud, a requirement for the IOI full color printing systems architecture.

4). The elimination of the HSD wires and wire module substantially reduces the complexity and cost of the development system.

5). Since the roll configuration (FIG. 2) utilizes the standard two-component hybrid design for donor loading, implementation at the current process width is possible without major subsystem or engine architecture redesign.

In recapitulation, there has been provided a wire-less HSD system for developing a latent image recorded on an imaging surface; a two component development is employed, and a uniform layer of toner is loaded onto a donor member. The donor member can be a roll or a continuous belt. A DC potential, or a combination of DC and AC voltages ($DC_L$ and $AC_L$), can be used in this loading step. The triboelectric charging of toner in the two component donor loading step is kept to a minimum by adjustments to the carrier coating and external surface additives on the toner. The toner layer thickness on the donor is controlled by the toner concentration in the developer and the bias between the donor and magnetic brush rolls. The toner charge is high enough for magnetic brush loading of the donor, but is low enough so as to minimize adhesion to the donor. Ion charging is then used to raise the charge level of the toner to a value that enables jumping development. Ion charging thus overwhelms the previous triboelectric charge signature on the toner particles, rendering them available for jumping development while keeping their adhesion low.

Other embodiments and modifications of the present invention may occur to those skilled in the art subsequent to a review of the information presented herein; these embodiments and modifications, as well as equivalents thereof, are also included within the scope of this invention.

We claim:

1. An apparatus for developing a latent image recorded on an imaging surface, comprising:

a housing defining a reservoir storing a supply of developer material comprising toner;

a donor member, spaced from the imaging surface, for transporting toner on an outer surface of said donor member to a region opposed from the imaging surface;

means for loading a toner layer onto a region of said outer surface of said donor member;

means for ion charging said toner loaded on the region of said donor member;

means for supplying an AC plus DC electrical biasing to said donor member positioned in close proximity to said imaging member to detach toner from said region of said donor member as to form a toner cloud for developing the latent image, said AC bias ranges from 0 to 1000 volts peak-to-peak; and means for discharging and removing residual toner on the region of said donor and returning said toner to the reservoir.

2. An apparatus for developing a latent image recorded on an imaging surface, comprising:

a housing defining a reservoir storing a supply of developer material comprising toner;

a donor member, spaced from the imaging surface, for transporting toner on an outer surface of said donor member to a region opposed from the imaging surface;

means for loading a toner layer onto a region of said outer surface of said donor member, said toner layer has a thickness on the donor surface is between 1 and 3 monolayers;

means for ion charging said toner loaded on the region of said donor member;

means for supplying an AC plus DC electrical biasing to said donor member positioned in close proximity to said imaging member to detach toner from said region of said donor member as to form a toner cloud for developing the latent image, and means for discharging and removing residual toner on the region of said donor and returning said toner to the reservoir.

3. An apparatus for developing a latent image recorded on an imaging surface, comprising:

a housing defining a reservoir storing a supply of developer material comprising toner;

a donor member, spaced from the imaging surface, for transporting toner on an outer surface of said donor member to a region opposed from the imaging surface, said donor member consisting essentially of a conductive sleeve having an insulating layer thereon;

means for loading a toner layer onto a region of said outer surface of said donor member;

means for ion charging said toner loaded on the region of said donor member;

a power supply for supplying an AC plus DC electrical biasing to said donor member to detach toner from said region of said donor member as to form a toner cloud for developing the latent image on said imaging surface; and means for discharging and removing residual toner on the region of said donor member and returning said toner to the reservoir.

4. The apparatus as recited in claim 3, wherein said ion charging means comprises a DC or AC corona device located adjacent to the surface of said donor member.

5. The apparatus as recited in claim 4, wherein said corona device charges the toner layer to an average charge to mass ratio of from 30 to 50 $\mu$C/g.

6. The apparatus as recited in claim 3, wherein said DC bias ranges from 0 to 1000 volts.

7. The apparatus as recited in claim 3, wherein said donor member is spacing is defined by a gap between said donor member and the imaging surface; and wherein said development gap is in the range of 0.125 to 0.75 mm.

* * * * *